US005752595A

United States Patent [19]

Fein et al.

[11] Patent Number: 5,752,595

[45] Date of Patent: May 19, 1998

[54] SEALED TOGGLE SWITCH WITH LED SWITCH

[75] Inventors: Berthold Fein; Adam Weber, both of Bietigheim-Bissingen, Germany

[73] Assignee: ITT Automotive Europe GmbH, Germany

[21] Appl. No.: 737,218

[22] PCT Filed: Apr. 27, 1995

[86] PCT No.: PCT/EP95/01602

§ 371 Date: Nov. 7, 1996

§ 102(e) Date: Nov. 7, 1996

[87] PCT Pub. No.: WO95/30993

PCT Pub. Date: Nov. 16, 1995

[30] Foreign Application Priority Data

May 7, 1994 [DE] Germany ..... 44 16 273.1

[51] Int. Cl.[6] ..... H01H 9/18

[52] U.S. Cl. ..... 200/315; 200/302.3

[58] Field of Search ..... 200/315, 302.3

[56] References Cited

U.S. PATENT DOCUMENTS

| | | | |
|---|---|---|---|
| 4,242,551 | 12/1980 | Sorenson | 200/315 X |
| 4,340,791 | 7/1982 | Sorenson | 200/315 X |
| 4,667,073 | 5/1987 | Osika | 200/315 X |
| 4,967,046 | 10/1990 | Preisemuth | 200/315 X |
| 4,982,061 | 1/1991 | Dignal | 200/315 X |
| 5,107,082 | 4/1992 | Valenzona | 200/315 X |

FOREIGN PATENT DOCUMENTS

| | | | |
|---|---|---|---|
| 0338521A2 | 10/1989 | European Pat. Off. | 200/315 X |
| 1840987 U | 9/1961 | Germany . | |
| GM6906798 | 2/1969 | Germany . | |
| GM7109985 | 6/1971 | Germany . | |
| GM7728264 | 12/1977 | Germany . | |
| 8017362.2 | 6/1980 | Germany . | |
| 3024510A1 | 1/1982 | Germany . | |
| 3034112A1 | 3/1982 | Germany . | |
| 3151273A1 | 7/1983 | Germany . | |
| 3306219A1 | 8/1984 | Germany . | |
| 3813350A1 | 11/1989 | Germany | 200/315 X |
| 3844484A1 | 7/1990 | Germany | 200/315 X |
| 4022514A1 | 1/1992 | Germany . | |
| WO80/01858 | 9/1980 | WIPO | 200/315 X |

OTHER PUBLICATIONS

PCT Search Report Application No. PCT/EP95/01602

German Search Report Application No. P4416273.1

*Primary Examiner*—Renee S. Luebke

*Attorney, Agent, or Firm*—Thomas N. Twomey; J. Gordon Lewis

[57] ABSTRACT

A water- and/or dust-tight toggle switch has an LED switch. The LED or other luminous elements are impermeably shielded from the surroundings by a housing of a comparatively simple design. The housing is provided with cast windows which make possible light output from the luminous element disposed within the interior of the housing. Favorable refinements pertain to the arrangement of a light guide on the actuator cap and also the protection of the inserted plug through extended, guided-down housing walls.

9 Claims, 2 Drawing Sheets

FIG 1
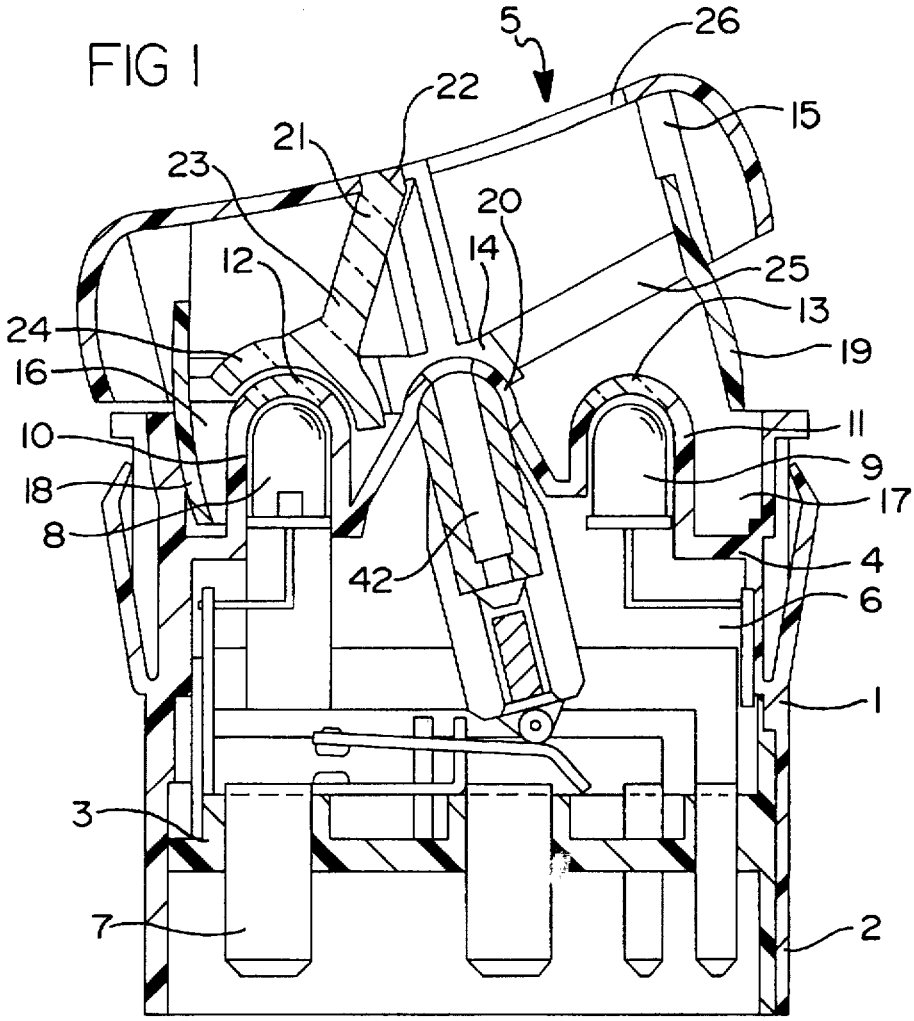
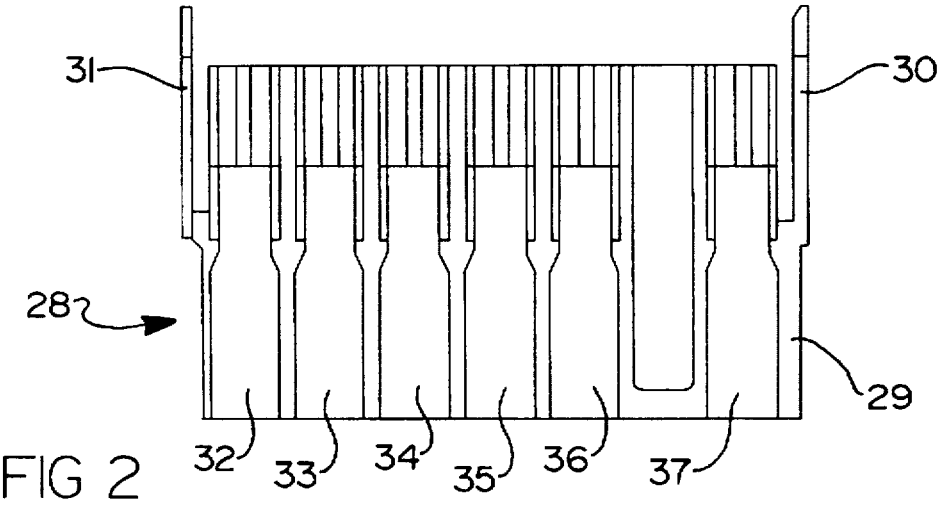
FIG 2

SEALED TOGGLE SWITCH WITH LED SWITCH

BACKGROUND OF THE INVENTION

For a number of practical applications it is necessary to have toggle switches which are designated to be water- and/or dust-tight. In DE-GM 18 04 987 a watertight toggle assembly on the housing cover of a switch is suggested. Another proposal for a seal of this type is indicated in DE-GM 71 09 985. Yet another requirement concerning these switches is that they should have an LED display which is intended to assist in locating the switch in the dark (seek function) and/or which is intended to display the switch status of the toggle switch and/or the function (functional display) switched with the toggle switch.

DE-OS 30 24 510 proposes that a filament lamp be placed in a separate chamber of the housing, which is separated from the chamber used by the switch contact. In this case, the light is only conditionally shielded against surrounding factors, whereas on the other hand, a comparatively complicated shape of the housing results.

It is desired to further improve a switch of this type so that the shape of the housing will be simplified and the luminous element is better protected against surrounding influences.

SUMMARY OF THE INVENTION

A lamp is included in the enclosed chamber and the housing itself is provided with a suitable window, through which the light flux can move into the interior space of the actuation key, where it then lights up symbols or windows located in the usual manner at the bottom of the key and is used to impart information to the operator.

In order to be able to emit most of the output light flux from the luminous element through the housing into the key space, the housing has a dome-like bulge with the window in it protruding end surrounding the lamp. Of course, this property can also be applied when using several lights in the switch and even with several lights for one key. Moreover, the stated structure is very space-saving and due to the steep, lateral dome walls, creates additional possibilities for sealing, as will be explained further below.

In yet another refinement of the invention, in order to prevent a more complicated cast shape, and, for example, when using several luminous elements, to be able to use the function display and/or seek display by mere disassembly or rotated installation of the key cap, it is recommended to have, for the actuation key, a pivot mounted actuator on which a cap engages.

In order to obtain a strong brightness contrast in the functional lighting depending on the selected function, a light guide attached opposite the window and in the front wall in one toggle position of the key is also recommended. Thus, a light guide connected to the cap and to the key can be guided close to the vicinity of the associated light window in the housing, and therefore in the vicinity of the luminous element; secondly, it can be removed from the light guide by the pivot motion of the key. Thus, the light guide can be positioned so that due to the pivoting motion, the angle of incidence of the light, in the one case, can be simultaneously brought into a position favorable for transmission, and in the other case, it can be brought into a position unfavorable for transmission.

A particularly favorable configuration for the light guide for the above-mentioned requirements can be found using a cup-like end piece. In order to obtain a particularly strongly-lit light display area on the surface of the key and/or the cap facing the observer, it is recommended, in a refinement of the invention, to fix the light guide to the cap. Accordingly, the light guide is conducted directly through the base of the cap, so that its end is visible to the observer. Thus the observer can directly perceive the light flux emitted from the end of the light guide. In this case, the light guide can also have the side contour of a symbol, so that this symbol then lights up very strongly in the appropriate switch setting.

As already mentioned, in order to be able to make significant changes in the light flux transmitted through the light guide as a function of the position of the toggle switch, in a refinement of the invention, it is recommended to position the light guide at an angle to the axis of the actuator lever. In order to obtain an additional protection in the terminal area of the switch, in a refinement of the invention, the base element is inserted relatively deeply into the interior of the housing, or stated differently, the side walls of the housing are pulled down over the side surface of the base plate in order to shield it laterally against surrounding factors.

Additional protective measures can consist in preventing pollutants from moving across the side surfaces of the plug-in contacts of a terminal to be plugged into the plug connector of the switch. In this case, the plug-in contacts of the plug connector to be plugged in are carefully insulated from each other, which can take place by means of corresponding sealing material or by casting of the plug contacts into the plug. Thus, as an added or optional feature, the outer contour of the plug connector against the guided-down side walls of the housing can be sealed by means of an appropriate sealing strip, so that neither dirt nor moisture can get into the preferably blade-shaped plug-in contacts of the switch.

In order to prevent any dust or moisture from settling on the front surface of the housing and having an adverse effect on light permeability of the housing windows and/or the sealing of the key in the housing, receptacle spaces are provided in the front surface of the housing and the lateral covers can pivot into them during the toggle motion of the key. Side walls of these spaces can be defined, for example, by the side walls of the housing bulges described above and which are used to hold the luminous elements. With the inserted covers, a labyrinth difficult for dust or water to overcome can be obtained. At the same time, the receptacle space can be used for collection of dirt or moisture to prevent it from entering the windows of the front surface of the housing located further up.

An additional measure to keep the front surface of the housing free is presented by the key which covers the front surface of the housing like a shield.

As was explained above, the switch of the invention is suitable not only for holding a single luminous element, but also for holding two or more luminous elements. If two luminous elements are used, the symmetric location of the second luminous element to the first is recommended. Accordingly, it is also possible to solve different problems with the similarly-designed switch in that in various settings, the key engages with the switch and/or the key cap with the actuator.

In order to ensure that the second luminous element always properly fulfills a search function, the illumination of the interior space by means of a window or opening is recommended. Accordingly, three transparent elements essentially aligned with each other independently of the switch setting are provided, wherein the first is designed as a window in the housing front, the second as an opening or window in the actuator, and the third as a light-permeable symbol or, under certain circumstances, a simple, colored window.

BRIEF DESCRIPTION OF THE DRAWINGS

FIG. 1 is a longitudinal section through the switch of the invention.

FIG. 2 is a side view of one possible connector plug for a switch according to FIG. 1.

DETAILED DESCRIPTION OF A PREFERRED EMBODIMENT

Figure 3:
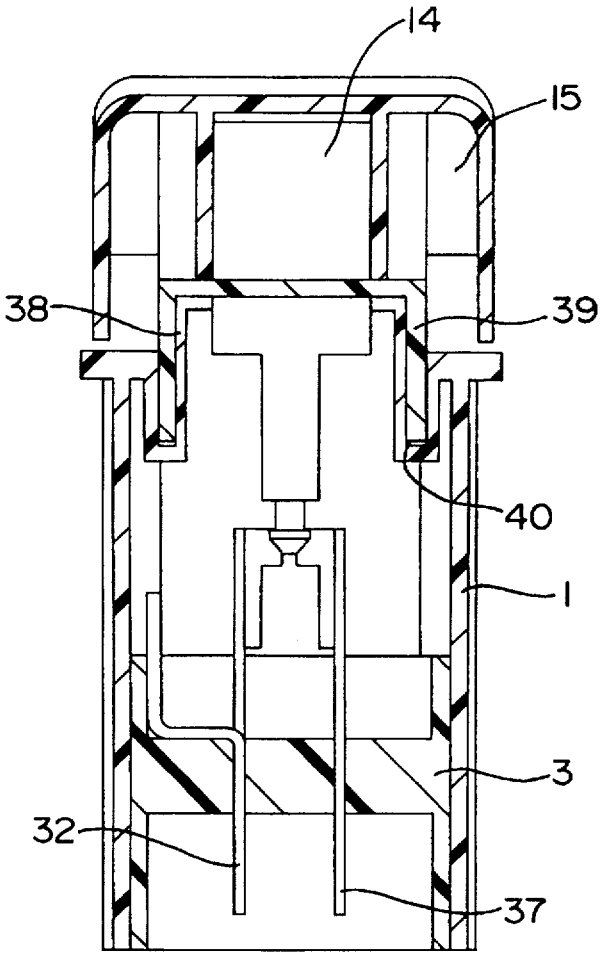
FIG. 3 is a cross section through the switch according to FIG. 1.

The present description deals with a further development of the subject matter of published German patent application No. 30 24 510. The present a document describes only properties which are new with respect to this description and essential to the present invention. The switch according to FIG. 1 features a housing 1 whose case side walls 2 are pulled far down and thus are used for protection of the connection strip of the base element 3. It is particularly important for the invention that the housing have on its upper end in FIG. 1, a solid front wall 4 which necessarily is interrupted only in one small, carefully sealed area in which an extension of the key 5 extends into the interior space 6 of the housing 1.

The base element 3 is inserted from below into the housing and engages with it. Contact blades 7 extend through and are cast with the base element; in a known manner these blades are connected to the fixed-site and also to the moving contact pieces 43 of a rocker contact. Actuator lever 42 is disposed between seal 20 and contact piece 43. In addition, the contact blades are connected in a suitable format to two luminous elements 8 and 9, wherein the luminous element 8 is used for function lighting and the luminous element 9 is used for search lighting. In this case, the lamps are held in mounts connected with the housing. Thus in the first place, the connection lines can be used to mount the luminous elements 8, 9. But the mounts can also be clamped between the side walls of two recesses 10, 11 of the front wall 4 of the housing 1. The mode of operation of the switch elements of the switch corresponds to that of the switch described in DE-OS 30 24 510 and is thus not repeated at this point.

It is particularly important for the invention that the two luminous elements 8, 9 be located in the interior space of the housing 1 and covered by the solid front wall 4. In order that the light flux emitted from the luminous elements 8, 9 can also reach and pass through the key 5, the front wall 4 is provided with two windows 12, 13 which are spherically bulged, transparent and cast with the housing 1. In the front wall, the key 5 is seated in a known manner (see DE-OS 30 24 510 or DE-AS 12 12 616 or DE-GM 18 04 987). In this case, the key 5 is composed of an actuator 14 and a cap 15, wherein the cap 15 engages with the actuator 14. Due to the division of the key 5 a simplified cast shape is obtained. The two part composition also enables the possibility of using the switch of the invention for other switching tasks merely through rotated installation of the cap 15 onto the actuator 14.

Particularly advantageous for the switch are the bag-like receiving spaces 16, 17 formed by the side walls 2 of the housing and the side walls of the bulges 10, 11 in the front wall, since possibly dust or moisture may collect there on the outer surface of the front wall 4. At the same time, the ends of two covers 18, 19 set on the sides of the actuator 14 penetrate the receiving spaces 16, 17 during the pivoting of the key 5, and thus block the path for dust and water on the surface of the front wall 4. Thus, in addition, the windows 12, 13 and the seal 20 of the key 5 are kept free from dirt with respect to the housing 1. In this case, the receiving spaces 16, 17 can be connected to each other by means of a running groove, into which a running wall linking the covers 18, 19 together is inserted.

A light guide 21 can engage in or be cast with the cap 15. The end 22 of the light guide forms a window in the surface of the cap 15 which can be lit very brightly. The contour of the end of the light guide 22 can also be configured as a symbol. The shaft 23 of the light guide passes into a cup 24 which surrounds the bulged window 12 in the front wall 4 and thus receives the light flux penetrating through this window and via the shaft 23 transfers it to the end 22 of the light guide. Whereas in the position shown in FIG. 1, the light passage from the window 12 to the cup 24 and thus to the light guide 21 is very simple, in a second tilted position of the key 5 not shown in FIG. 1, the cup is raised above the window 12 and oriented at an oblique angle to it. Thus the light coming from the window 12 can hardly enter the cup 24, so that due to the dark end 22 of the light guide, the switch setting not illustrated in FIG. 1 will be indicated to the operator.

But in order to provide an equivalent indication of the position of the switch to the operator in the dark, a second luminous element 9 is used, whose light, via the window 13 and a recess 25 (which can also be configured as a window) in the actuator 14 and also a light-permeable window 26 in the cap 15, can reach the observer. The window 26 can have the contour of a symbol and be cast into the cap 15 or it can be light-permeable due to a corresponding thinning of the window region 26. But in particular, it is recommended to make the inner surface of the cap 15 reflective by means of a white coating or a spray-coated white layer, which can serve simultaneously as window 26.

FIG. 2 shows the possibility of designing a plug connector suitable for sealing of the switch according to FIG. 1. In this case, the plug connector can have laterally protruding brackets 30, 31 on the plug housing 29, which, in the first place, ensures a sealing between plug 28 and the connection strip of the switch in conjunction with the side walls 2, and, in the second place, enables engagement of the plug 28 in the switch housing 1. The receiving contacts 32 to 37 can be cast for improved sealing, either in the housing 29 or its surroundings, by means of a sealing material 33.

In the symmetrical arrangement of the luminous elements 8, 9, it is particularly favorable that in the one key position with light guide 24 seated on the front wall 4, the switched-on function at the end 22 of the light guide is indicated particularly clearly. But in the other position, due to the pivoting window 26 toward the luminous element 9 in the switched-off state of the functional lighting, the search lighting is particularly easy to see. As explained above, FIG. 3 shows how the covers 18, 19 are designed by means of lateral walls 38, 39 as a running wall. The same also applies to the receiving spaces 16, 17, which, as is evident in FIG. 3, can be interconnected in the longitudinal direction of the switch so that a channel 40 is created into which the running wall is inserted.

We claim:

1. An illuminated sealed toggle switch comprising:

a housing having a continuous front wall enclosing a luminous element with a window of light-permeable material over the luminous element;

an actuation key pivotally mounted to the front wall of the housing and acting on a moving contact piece disposed within the housing, the actuation key including a pivot mounted actuator on which a cap engages; and a light guide having two ends, the first of which being attached to the cap and the second of which being located adjacent to the window in the front wall and being a cup-like end piece enclosing a section of a housing bulge with the window in a corresponding toggle position of the key.

2. A switch as claimed in claim 1 wherein the front wall has at least one dome-like bulge which has on a protruding end thereof the window with the bulge surrounding the luminous element.

3. A switch as claimed in claim 1 wherein the first end of the first end of the light guide extends through the cap and is exposed for viewing to a switch operator.

4. A switch as claimed in claim 1 wherein the light guide is positioned at an angle to a longitudinal axis of the actuator lever branching off from the cap.

5. A switch as claimed in claim 1 wherein a lower end of the housing has a base element bearing the switch contacts and also a connector plug and the housing has side walls extending past free ends of the connector plugs, forming control walls for the connector plugs.

6. A switch as claimed in claim 1 wherein one of the cap and the actuator of the key is provide with covers facing the housing which during toggle motion of the key enter into receiving spaces associated with the covers in the housing.

7. A switch as claimed in claim 1 wherein a second luminous element is located within the housing essentially symmetrical to the first luminous element.

8. A switch as claimed in claim 7 wherein the second luminous element illuminates an interior space of the key by means of a window of the housing.

9. A switch as claimed in claim 8 wherein the actuator has an opening aligned with the second luminous element for illumination of an interior space of the key.

* * * * *

UNITED STATES PATENT AND TRADEMARK OFFICE

CERTIFICATE OF CORRECTION

PATENT NO. : 5,752,595

DATED : May 19, 1998

INVENTOR(S) : Fein et al.

It is certified that error appears in the above-indentified patent and that said Letters Patent is hereby corrected as shown below:

Column 6, line 9, the word -provide- should be "provided" therefor.

Signed and Sealed this

Eighteenth Day of August, 1998

Bruce Lehman

*Attest:*

BRUCE LEHMAN

*Attesting Officer*

*Commissioner of Patents and Trademarks*